US008348383B2

(12) United States Patent
Kobayashi

(10) Patent No.: US 8,348,383 B2
(45) Date of Patent: Jan. 8, 2013

(54) PRINTING DEVICE AND METHOD

(75) Inventor: Taisei Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 218 days.

(21) Appl. No.: 12/875,451

(22) Filed: Sep. 3, 2010

(65) Prior Publication Data

US 2011/0057974 A1 Mar. 10, 2011

(30) Foreign Application Priority Data

Sep. 10, 2009 (JP) ..... 2009-209080

(51) Int. Cl.
*B41J 23/00* (2006.01)

(52) U.S. Cl. ..... 347/37; 16/19

(58) Field of Classification Search ..... 347/6, 14, 347/16, 19, 37
See application file for complete search history.

(56) References Cited

U.S. PATENT DOCUMENTS

| | | | | |
|---|---|---|---|---|
| 4,602,882 | A * | 7/1986 | Akazawa | 400/322 |
| 5,074,690 | A * | 12/1991 | Del Signore et al. | 400/322 |
| 5,238,315 | A * | 8/1993 | Kitabata | 400/314.1 |
| 2004/0141782 | A1* | 7/2004 | Kato | 400/61 |
| 2007/0291063 | A1* | 12/2007 | Akase et al. | 347/14 |

FOREIGN PATENT DOCUMENTS

| | | | |
|---|---|---|---|
| JP | S64-072875 | A | 3/1989 |
| JP | 2007-326257 | A | 12/2007 |

OTHER PUBLICATIONS

Japanese Office Action issued from the Japanese Patent Office dated May 18, 2011 for the corresponding Japanese patent application No. 2009-209080.

* cited by examiner

*Primary Examiner* — Julian Huffman
*Assistant Examiner* — Sharon A Polk
(74) *Attorney, Agent, or Firm* — Posz Law Group, PLC

(57) ABSTRACT

A printing device includes a carriage control part that reciprocates a carriage, a print control part that confirms an origin point of the carriage by a position detecting part, a carriage moving time calculation part that calculates a first moving time (B) and a second moving time (C), and a line feed time calculation part that calculates a third time (A). The first moving time is a period during which the carriage moves from a carriage position to the position detection part after print completion, and the second moving time is a period during which the carriage moves from the position detection part to a next print starting position. The third time (A) is a period during which the recording medium is carried from the print completion to the next print position. The position control part executes an origin point confirmation operation of the carriage when (B+C<A).

12 Claims, 11 Drawing Sheets

| Rotation Step | Step Time / Pulse | Transferring Amount / Pulse |
|---|---|---|
| Acc. Step 1 | Tacc 1 | 1/180 inch (0.14mm) |
| Acc. Step 1 | Tacc 2 | ↑ |
| Acc. Step 1 | Tacc 3 | ↑ |
| ·<br>·<br>· | ·<br>·<br>· | ↑ |
| Acc. Step N | TaccN | ↑ |
| Const. Step F Time(s) | Tth | 1/180 inch (0.14mm) × F |
| Dcl. Step 1 | Tdcc1 | 1/180 inch (0.14mm) |
| Dcl. Step 2 | Tdcc2 | ↑ |
| Dcl. Step 3 | Tdcc3 | ↑ |
| ·<br>·<br>· | ·<br>·<br>· | ↑ |
| Dcl. Step N | TdccN | ↑ |

Fig. 5

PRINTING DEVICE AND METHOD

CROSS REFERENCE

The present application is related to, claims priority from and incorporates by reference Japanese patent application number 2009-209080, filed on Sep. 10, 2009.

TECHNOLOGY FIELD

The present application relates to a printing device such as a serial printer and a method of printing.

A printing process on a recording medium using a serial printer is generally performed by moving a carriage in which a print head is equipped in a first scanning direction.

In this case, a direct current (DC) motor or a stepping motor is used to move the carriage in the first scanning direction.

When the DC motor is used, the moving amount of the carriage is monitored by the pulse number generated from a slit encoder that rotates together with the moving carriage. A control part recognizes the moving amount and the current position of the carriage by counting the pulse number. Also, when any abnormality occurs, for example, if the motor becomes out of control, the control part recognizes the abnormality by observing variation of the pulse number.

On the other hand, a conventional printing device using a stepping motor performs a positional alignment at an origin point of a carriage, in which a print head is equipped, by moving the carriage in a lateral direction (right-left) until an origin point detecting sensor detects the carriage. After the alignment is completed, the positional controlling of the carriage is performed by logically recognizing the current position of the carriage based on the pulse number that was provided to the stepping motor. See Japanese Laid-Open Publication No. S64-72875.

However, with the technology disclosed in the JP Laid-Open Publication No. S64-72875, because the current position of the carriage is logically recognized by the pulse number that is provided to the stepping motor after the alignment at the origin point is completed, in a case where the stepping motor malfunctions during printing, a difference between a logical position and a physical position of the carriage cannot be recognized if such a difference occurs. Herein, the logical position refers a position that is logically recognized based on the pulse number. The physical position is the actual position where the carriage exists.

Therefore, with the conventional printing device, the recording medium is carried by line after the print operation is completed according to a predetermined timing (i.e., by a few lines, by page break, by a few pages or the like). After that, the carriage is moved to a position of the origin point detecting sensor, and then the logical position and the physical position are coincided based on an output (or detecting condition) of the origin point detecting sensor.

In this case, the operation time for confirming the origin point is determined with a total time combining the time for the carried line (or one line feed) and the moving time of the carriage to the origin point sensor. Moreover, since the moving time varies according to the location where the printing completed, the moving time may take longer depending on where the print completed, which increases the operation time for confirming the origin point. This deteriorates the processing efficiency of the print processing.

In order to solve the above problem, the present application is to provide a device to shorten the operation time for confirming the origin point.

SUMMARY

In order to solve the problem, a printing device of the present invention includes: a carriage control part that reciprocates a carriage, in which a print head is installed, in a first scanning direction; a print control part that provides print data to the print head; a carrying part that carries a recording medium that is printed by the print head; a position detecting part that is provided on an origin point that is set on a path of the carriage; and a position control part that confirms the origin point of the carriage by the position detecting part; a carriage moving time calculation part that calculates a first moving time (B) and a second moving time (C), wherein the first moving time is defined as a period during which the carriage moves from the carriage position to the position detection part after a print completion, and the second moving time is defined as a period during which the carriage moves from the position detection part to a next print starting position; and a line feed time calculation part that calculates a third time (A) defined as a period during which the recording medium is carried from the print completion to the next print position. The position control part executes an origin point confirmation operation of the carriage by the position detection part when a sum of the first and second times is less than the third time (B+C<A).

Another printing device of the present invention includes: a carriage control part that reciprocates a carriage in which a print head is installed in a first scanning direction; a print control part that provides print data to the print head; a carrying part that carries a recording medium that is printed by the print head; a position detecting part that is provided on an origin point that is set at one end in a moving direction of the carriage; and a position control part that confirms the origin point of the carriage by the position detecting part; and a control part that determines whether the moving direction of the carriage is toward the position detecting part; wherein, if the moving direction of the carriage is toward the position detecting part, the position control part calculates a distance that is from a position of the carriage when a print operation is completed to the position detecting part, and the position control part moves the carriage toward the position detecting part when the distance is a predetermined distance (G) or less, the position detecting part executes an origin point confirmation operation of the carriage.

Further, the present application discloses a method executed with the printing device.

With the structure, the present application shortens the time for confirming the origin point, and improves the processing efficiency of the print processing.

BRIEF DESCRIPTIONS OF DRAWINGS

FIG. 5 is an explanatory diagram showing step time(s) of the space motor of the first embodiment.

DETAILED DESCRIPTIONS

Figure 1:
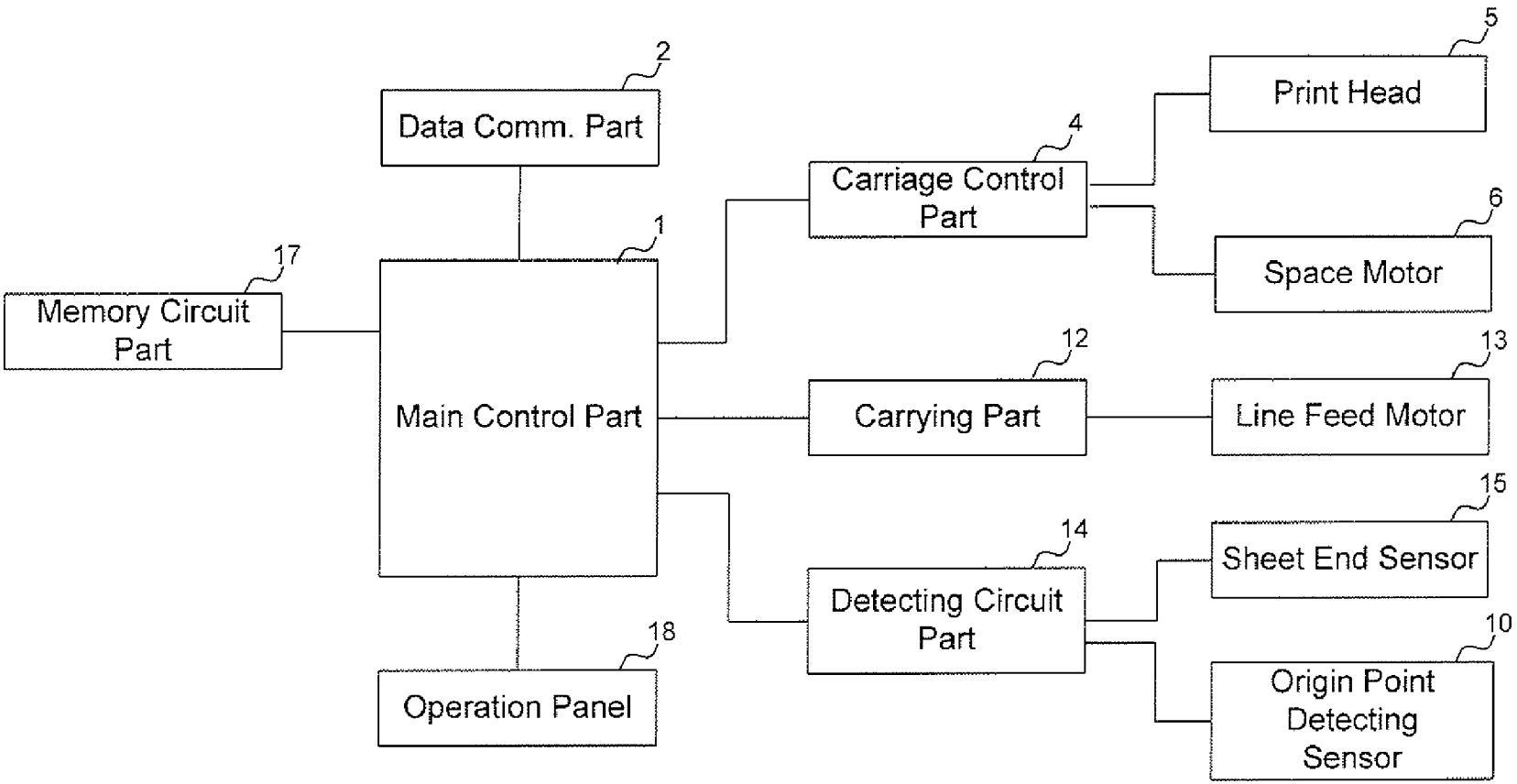
FIG. 1 is a block diagram showing a structure of a print device of a first embodiment.

Hereafter, embodiments of a printing device of the present application is explained referring to the drawings.

(First Embodiment)

Referring to FIG. 1, a main control part 1 of the printing device receives print request information, such as control data, print information and control signals, from a host device such as a personal computer, which is not shown in figures, via a data communication part 2 and interprets the received print request information or develops received data to an image buffer.

The data communication part 2 receives various data from the host device or sends/receives control signals with the host device.

A numeral 4 refers to a carriage control part 4. A numeral 5 refers to a print head 5 that includes a plurality of dot pins for printing predetermined dot patterns that is generated by the main control part 1. A numeral 6 refers to a space motor 6 configured with a stepping motor. When, for example, the printing device is a dot printer, the space motor 6 functions to reciprocate the print head 5 in a first scanning direction, which is a width direction of a sheet P as a recording medium (an orthogonal direction with respect to a sheet carrying direction). Further, the carriage control part 4 functions to print dot patterns on the sheet P during the reciprocating paths (outgoing and incoming) of the print head 5 by controlling a the print bead 5 and the space motor 6. In the present application, the recording medium is defined as any types of material which has a thin shape and on which toner or ink images are printed, for example, a sheet made of paper, a plastic film for an overhead projector (OHP), and labels. In addition, as long as it is a printable, thin fabric is also included in the recording medium.

When the printing device is an inkjet printer, the print head 5, which includes a plurality of nozzles, is used.

Figure 2:
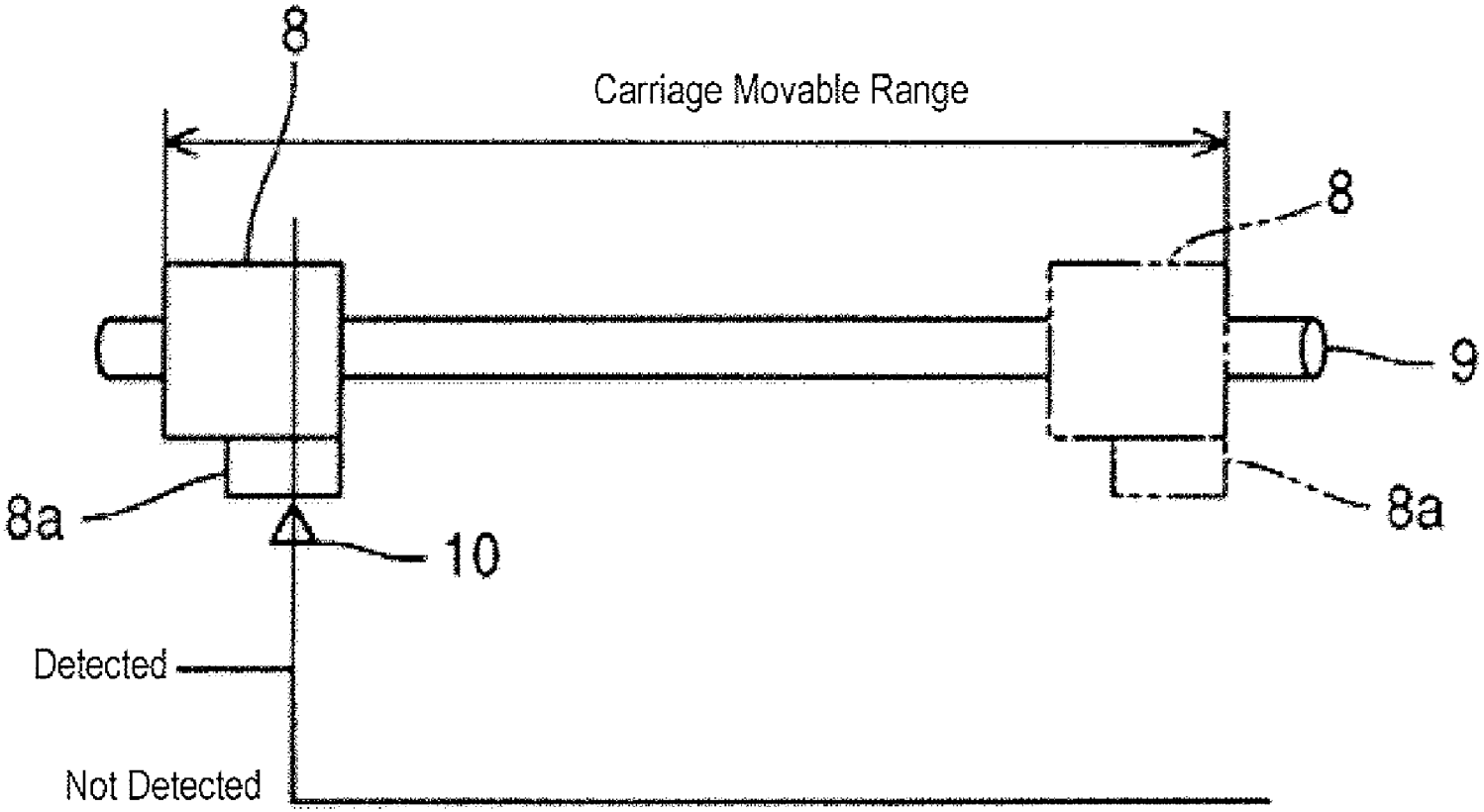
FIG. 2 is an explanatory diagram showing a carriage of the first embodiment.

Referring to FIG. 2, a carriage 8, which is a unit providing the print head 5, reciprocates on a guide axis 9. In the unit 8, a protrusion 8*a*, which serves as a position detecting part, is provided on an optical axis of an origin point detecting sensor 10, which has an optical mechanism so that sensing light from the origin point detecting sensor 10 is interrupted.

The origin point detecting sensor 10 is provided on a main body of the device and is provided at an origin point that is set at one end part in a carrying direction of the carriage 6 (in the present embodiment, at the left side end part with respect to the carrying direction).

Referring to FIG. 1, a carrying part 12 includes a line feed motor for carrying the sheet P in the carrying direction (the same direction as a slow-scanning direction that is orthogonal to the first scanning direction), and functions to conduct a one line feed by carrying the sheet P that is printed by the print head 5.

A detecting circuit part 14 is electrically connected to a sheet end sensor 15, which detects if the sheet P exists, and the origin point detecting sensor 10, which is provided at the origin point that is a standard of a position control of the carriage 8 that is moved by the space motor 6. The detecting circuit part functions to output detection signals from the sheet end sensor 15 and the origin point detecting sensor 10 to the main control part 1.

A memory circuit part 17, or memory part, provides a buffer memory, a random access memory, a nonvolatile memory and a flash memory or the like. The buffer memory stores print data transmitted from the main control part 1 and develops the print data into an image buffer (data) in order to print the data. The random access memory stores sheet end position information that is output from the sheet end sensor 15 in the detecting circuit part 14, carriage position information indicating the current position of the carriage 8, various types of data used by the main control part 1, and processing result or the like processed by the main control part 1. The nonvolatile memory stores setup mode data (pr menu setting) that is determined with an operation panel 18. The flash memory stores programs executed by the main control part 1.

In the carriage position information, a logical current position of the carriage 8 is memorized and updated every time the carriage 8 moves. The logical current position of the carriage 8 is recognized with the number of the positive and negative pulses that are provided to the space motor 6, with respect to the logical origin point that is corrected by the origin point detecting sensor 10.

An operation panel 18 is formed from an operation key that is not shown in the figure for setting up operation mode, an LED display part for displaying the operation condition, and an LED lamp or the like.

Figure 3:
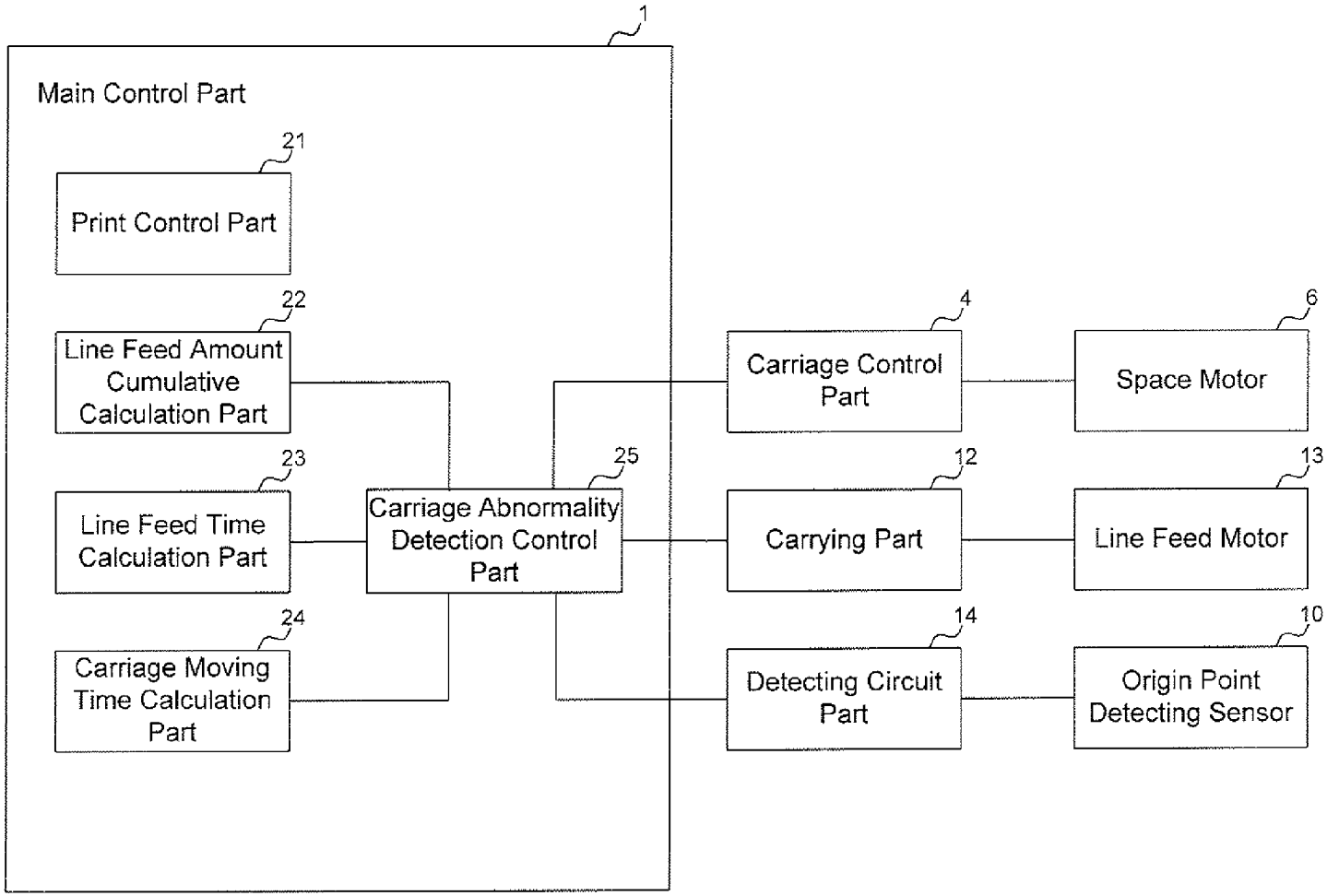
FIG. 3 is a block diagram showing a structure of a main control part of the printing device of the first embodiment.

In FIG. 3, a print control part 21 is formed in a main control part 1 and has a function to create various kinds of information related to printing, for example, print data such as impact data, print starting position information, print completing position information or the like, based on the received print request information and a function to provide the created print data or the like to the print head 5.

A line feed amount cumulative calculation part 22 is formed in the main control part 1, and the part has at least two functions. The first is to calculate and count a cumulative line feed amount from a previous origin point confirmation operation (later mentioned) to a current position by a length unit. The second function is to generate a malfunction detection request when the cumulative line feed amount exceeds a judgment line feed amount Ks (unit: inch), which is a predetermined line feed amount that has been stored in the memory of a memory circuit part 17, and to set a flag (in the present embodiment, "1" at the occurrence, and "0" at resetting) indicating that the malfunction detection is necessary in the memory area of the memory circuit part 17.

Moreover, in the memory of the memory circuit part 17, an upper limit line feed amount Kj (unit: inch), which is a line feed amount for forcibly executing the origin point confirmation operation is preset and stored for when a period for which the origin point confirmation operation is not able to be executed becomes long because it does not match the judgment condition (later mentioned) for executing the origin point confirmation operation.

A line feed time calculation part 23 is formed in the main control part 1 and has a function to calculate a line feed time A (or third time), which is a carrying period of a single line from the current line to the next line of the sheet P.

A carriage moving time calculation part 24 is formed in the main control part 1 and has a function to calculate a carriage moving time B (or first moving time) and a carriage moving time C (or second moving time). The carriage moving time B is a moving period of the carriage 9 from the current position of the carriage 8 to the origin point in which the origin point detecting sensor 10 is provided. The carriage moving time C is moving period of the carriage 8 from the origin point to the print starting position of the next line.

A carriage abnormality detection control part 25 serves as a position control part and is formed in the main control part 1. The carriage abnormality detection control part 25 has a function to determine availability of the origin point confirmation operation based on the line feed time A that is calculated by the line feed time calculation part 23 and the carriage moving times B and C that are calculated by the carriage moving time calculation part 24. The control part 25 also has a function to move the carriage 8 to the origin point that is logically recognized by the space motor 6 of the carriage control part 4 while executing the line feed operation by the line feed motor 13 of the carrying part 12 and then to confirm if the logical position and the physical position of the carriage 8 are matched by detecting whether or not the origin point detecting sensor 10 detects the moved carriage 8. When the logical and physical positions are not matched, the control part 25 initializes the logical carriage position information in the memory circuit part 17, using the position detected by the origin point detecting sensor 10 as the origin point, and executes the origin point confirmation operation to edit the carriage position information of the memory circuit 17 by initializing the information.

The solid lines connecting blocks in FIG. 3 indicates flows of information regarding the execution of the origin point confirmation operation.

In this embodiment, the print control part 21, the line feed amount cumulative calculation part 22, the line feed time calculation part 23, the carriage moving time calculation part 24 and the carriage abnormality detection control part 25 are operated with computer programs that are executed by the main control part 1. However, these parts might be configured as hardware specializing in each function.

With respect to a calculation of the line feed time A by the line feed time calculation part 23, since a moving amount per a single pulse of the line feed motor 13 of the present embodiment is 1/360 inches (0.07 mm), in the case where the line feed speed is 5 inches/second and where the line feed amount to the next line is 1 inch, the line feed time A is calculated 0.2 seconds. In another case where the moving amount per a single pulse of the line feed motor 13 is 1/432 inches (0.06 mm), the line feed time A is calculated the same time as the above because the line feed speed is identical.

With respect to a calculation of the carriage moving time B by the carriage moving time calculation part 24, since the moving amount per a single pulse of the space motor 6 of the present embodiment is 1/180 inches (0.014 mm), in the case where the line feed speed is 15 inches/second, and where the line feed amount is 5 inches, the carriage moving time B is calculated 0.34 seconds.

Figure 4:
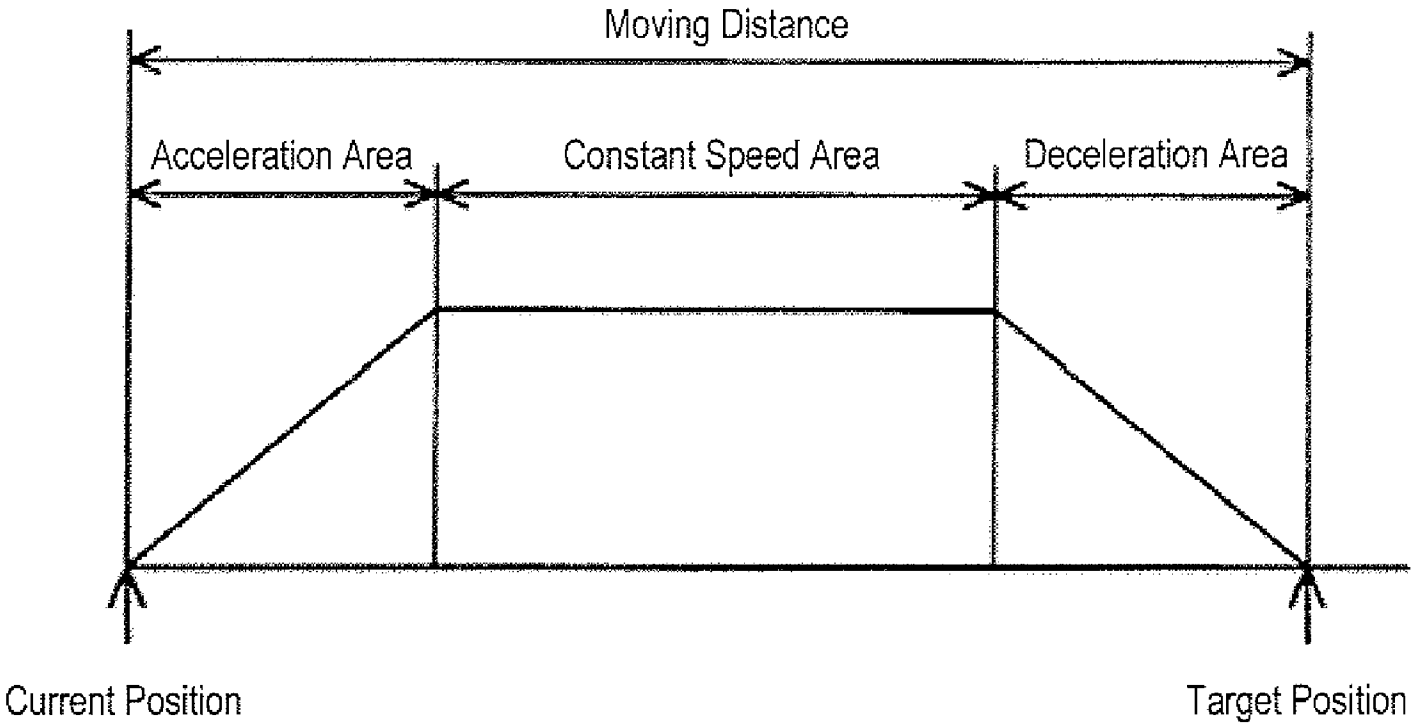
FIG. 4 is an explanatory diagram showing moving operation of a space motor of the first embodiment.

The moving of the carriage 8 starting from the current position to the target position of this case, as shown in FIG. 4, is formed with an acceleration area, a constant speed area and a deceleration area. The step time(s) per single pulse for the acceleration area, the constant speed area and the deceleration area are configured so that they are different each other as shown in FIG. 5.

The acceleration step number and the deceleration step number are configured to be constant with respect to the moving speed. Accordingly, when the total step number to the target position is determined, each of the step times are calculated follows:

$$\text{Acceleration step time}=Tacc1+Tacc2+Tacc3+\ldots+TaccN \quad (1)$$

$$\text{Deceleration step time}=Tdcc1+Tdcc2+Tdcc3+\ldots+TdccN \quad (2)$$

$$\text{Constant speed step time}=Tth\times(\text{total step number}-(\text{acceleration step number}+\text{deceleration step number})) \quad (3)$$

$$\text{Carriage moving time}=\text{acceleration step time}+\text{constant speed step time}+\text{deceleration step time} \quad (4).$$

The acceleration step time is configured to be shorter in the order of Tacc1, Tacc2, Tacc3 . . . TaccN. The deceleration step time is configured to be longer in the order of Tdcc1, Tdcc2, Tdcc3 . . . TdccN.

Figure 6A:
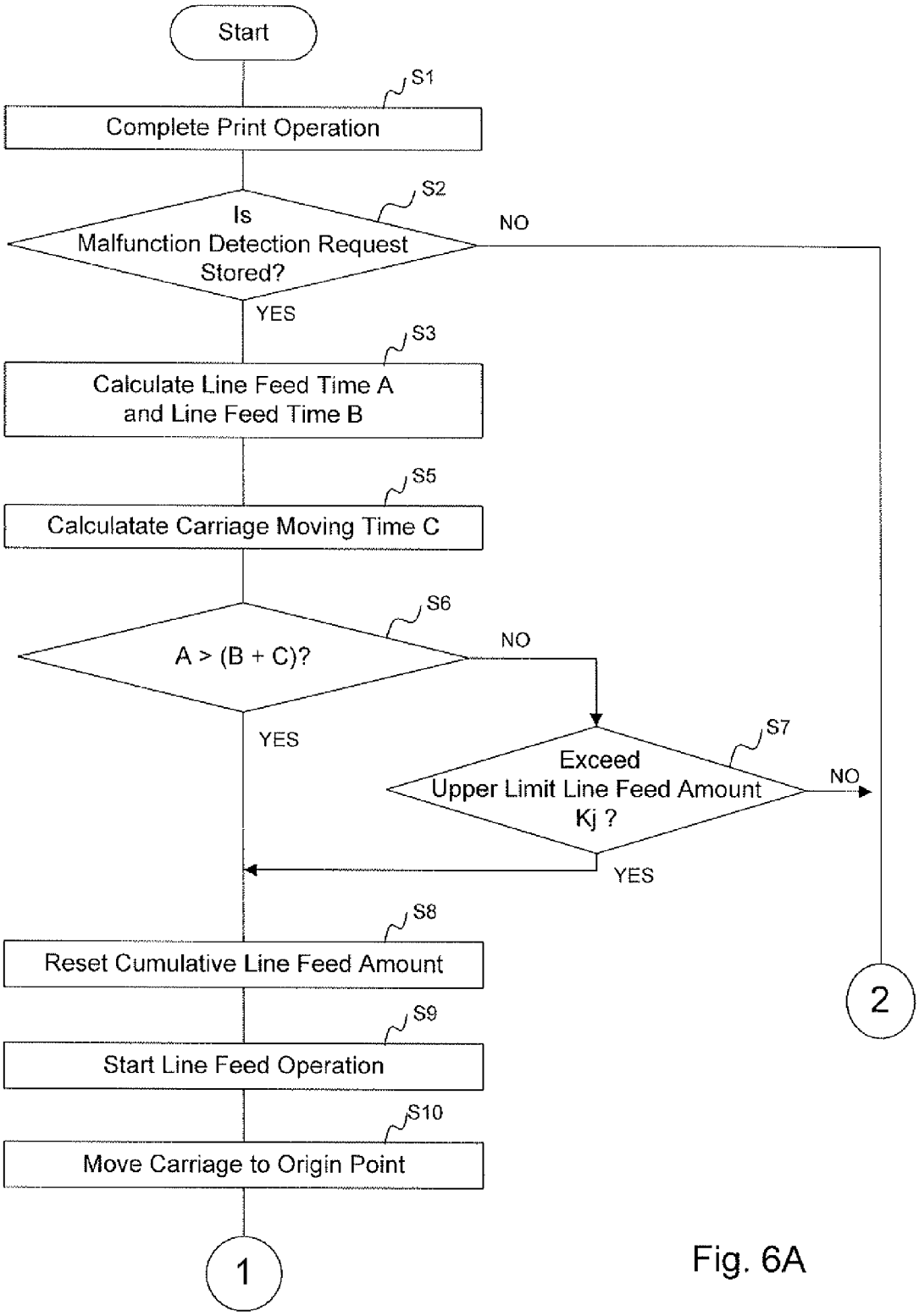
FIGS. 6A and 6B are flow diagrams showing an origin point confirmation processing of the first embodiment.
Figure 6B:
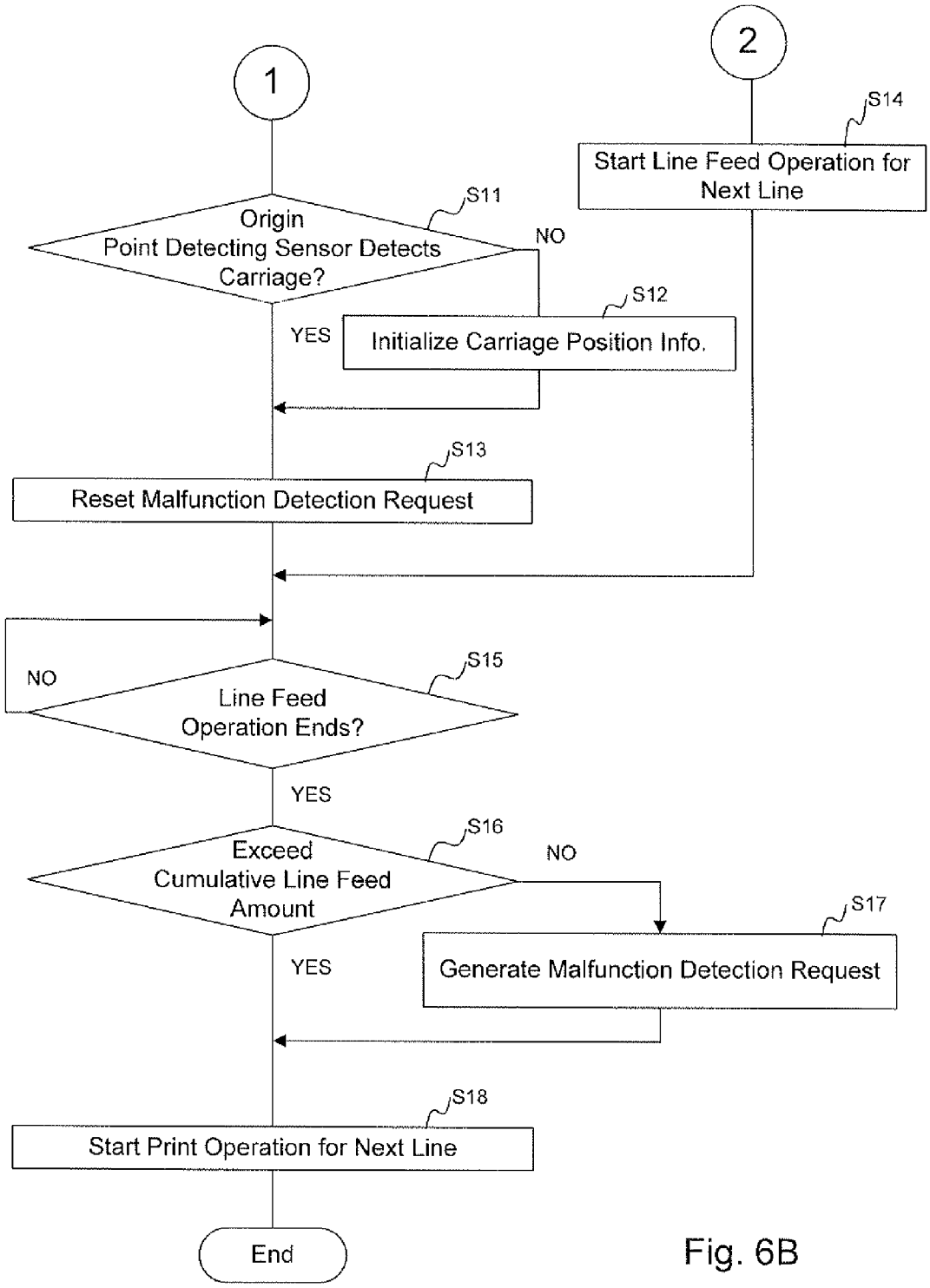

Hereafter, the origin point confirmation processing of the present application is explained followed by the steps shown in FIG. 6.

When the power of the printing device is turned on, a program that is stored in the memory of the memory circuit part 17 is automatically activated, and the main control part 1 executes an initial operation for the on-power.

Particularly, the main control part 1 rotates the space motor 6 by the carriage control part 4, moves the carriage 8 in the first scanning direction, and stops the carriage 8 by decelerating when the origin point detecting sensor 10 detects the carriage 8. The control part 1 initializes the carriage position information of the memory circuit part 17 to "0" referring to the detected position as the origin point, performs an origin point detecting operation that makes the physical position and logical position of the carriage 8 the same, and starts a print operation when the print request information from a host device is received via the data communication part 2.

At S1, the main control part 1 that starts the print operation sends the print data that is generated at the print control part 21 to the carriage control part 4, performs a printing for a single line on the sheet P while moving the carriage 8 by the carriage control part 4, and completes the print operation of the single line when printing reaches the end of the line.

At S2, after the print operation for the single line is completed, the main control part 1 searches the memory circuit part 17 and confirms a presence or absence of the malfunction detection request. The main control part 1 proceeds to S3 if the malfunction detection request has been generated. The malfunction detection request has been generated when the flag indicating that the malfunction detection is necessary is stored in the memory area of the malfunction detection requesting flag (see S17). When the malfunction detection request flag is not stored in the memory area (reset condition at S13), the processing proceeds to S14 in order to determine the execution of the print operation of the next line.

At S3, the main control part 1 calculates the line feed time A for the single line by the line feed time calculation part 23 and sends the line feed time A to the carriage abnormality detection control part 25.

Concurrently, the main control part 1 recognizes the current position of the carriage 8 after the print operation for the single line based on the carriage position information that is memorized in the memory circuit part 17 by the carriage moving time calculation part 24. Then, the main control part 1 calculates, using the calculated current position the carriage moving time B, which is a period for moving from the current position to the origin point at which the origin point detecting sensor 10 is provided, and sends the moving time B to the carriage abnormality detection control part 25.

In the embodiment, line feed time A (S3), the moving time B (S3), and the moving time C (S5) are calculated in this order. However, the order of the calculation is arbitrarily set for its design purpose. Any of the moving times A, B, and C may be calculated first.

At S5, the main control part 1 calculates the carriage moving time C, which is a period for moving from the origin point at which the origin point detecting sensor 10 is provided to the print starting position of the next line, and sends the moving time C to the carriage abnormality detection control part 25.

The carriage moving time C is practically a traveling period of the carriage 8 during which the carriage 8 travels to the next line. Therefore, this is not an independent operation. However, when the carriage moving time C is long, the time for starting the next line of printing is also long. Accordingly, the moving time C is required in order to reduce the time during which the print operation is not executed.

The carriage moving time C is a value to be calculated only when the print starting position of the next line has been determined. When the print data of the next line does not exist or when the print data for the next line has not been determined due to a delay of the data transmission from the host device, the carriage moving time C is considered "0" because it is not necessary to consider.

At S6, the main control part 1 determines by the carriage abnormality detection control part 25 if the sum of the carriage moving time B and the carriage moving time C is less than the line feed time A. When the sum is equal to or less than the line feed time A, the main control part 1 determines that execution of the origin point position confirmation operation is possible and proceeds to S8. On the other hand, when the sum is equal to or larger than the line feed time A, the main control part 1 determines that the execution of the origin point position confirmation operation is impossible, and proceeds to S7.

With such processing, the execution of the origin point confirmation operation is determined positive (executable) or negative (inexecutable) based on the judgment condition considering the carriage moving time C.

At S7, the main control part 1 compares the current cumulative line feed amount, which is calculated at the line feed amount cumulative calculation part 22, and the upper limit line feed amount Kj, which is stored in the memory of the memory circuit part 17. When the current cumulative line feed amount exceeds the upper limit line feed amount Kj, the main control part 1 determines to execute the origin point confirmation operation, and the process moves to S8. Specifically, the line feed amount cumulative calculation part 22 generates a request of the origin point confirmation operation for the main control part 1. According to the request, the carrying part 12 and/or the carriage control part 4 works to operate the origin point confirmation operation. When the current cumulative line feed amount is equal or less than the upper limit line feed amount Kj, the main control part 1 determines the execution of print operation for the next line, and the process moves to S14.

The reason that the origin point confirmation operation is executed is to avoid a malfunction of the stepping motor by confirming whether or not the stepping motor is working properly. Particularly, that is because when a print pattern in which the sum of the carriage moving times B and C is equal to or greater than the line feed time A continues, the origin point confirmation operation cannot be performed for a long time even if the malfunction detection request has occurred.

At S8, the main control part 1, which determined the execution of the origin point confirmation operation or determined to execute the origin point confirmation operation, resets the cumulative line feed amount to "0" by the line feed amount cumulative calculation part 22.

At S9, the main control part 1 starts the line feed operation by rotating the line feed motor 13 in the carrying direction of the sheet P with the carrying part 12 in order to simultaneously execute the moving operation of the carriage 8 to the origin point, at which the origin point detecting sensor 10 is provided, and the line feed operation to the next line.

At S10, at the same time, in order to stop the carriage 8 at the origin point by the carriage abnormality detection control part 25, the main control part 1 calculates the total step number from the current position that includes the acceleration area to the origin point, supplies the pulse to the space motor 6, the pulse corresponding to the time table shown in FIG. 5 by the carriage control part 4, then stops the carriage 8 after moving the carriage 8 to the logical origin point.

At S11, the main control part 1 confirms a detection signal from the origin point detecting sensor 10, the detection signal coming through the detecting circuit part 14 to the carriage abnormality detection control part 25. When the detection signal that indicates the detection of the carriage 8 is output from the origin point detecting sensor 10 (refer to FIG. 2), the main control part 1 determines that the logical origin point and the physical origin point match, which is a normal state. The process then moves to S13. On the other hand, when the detection signal that detects the carriage 8 from the origin point detecting sensor 10 is not output, the main control part 1 determines that the logical origin point and the physical origin point do not match and determines that the carriage position is abnormal. The process then moves to S12

At S12, the main control part 1, which determined the carriage position abnormality, edits the carriage position information of the memory circuit 17 by initializing the information to "0", in a manner like the origin point detecting operation when the power is turned on, and coincides the logical origin point and the physical origin point of the carriage 8. The process then moves to S13.

At S13, the main control part 1 rewrites the flag of the memory area of the malfunction detection request flag of the memory circuit part 17, by the line feed amount cumulative calculation part 22, and resets the malfunction detection request.

On the other hand, at S14, the main control part 1 rotates the line feed motor 13 in the carrying direction of the sheet P by the carrying part 12, starts the line feed operation for the next line, and proceeds to S15.

At S15, after the line feed operation has started, the main control part 1 monitors the progress of the line feed operation and proceeds to S16 when it is confirmed that the line feed operation has ended. When the line feed operation continues, the monitoring continues.

When the origin point confirmation operation is executed, the line feed operation might end before S13 is completed. In this case, the completion of the line feed operation is confirmed at S15, and then the process moves to S16.

At S16, the main control part 1 updates the cumulative line feed amount by adding a line feed amount at the line feed operation of the current process to the cumulative line feed amount of the previous origin point confirmation operation and compares the updated cumulative line feed amount with the judgment line feed amount Ks, which is stored in the memory circuit part 17. When the updated cumulative line feed amount exceeds the judgment line feed amount Ks, the process moves to S17. When the updated cumulative line feed amount is equal to or less than the judgment line feed amount Ks, the main control part determines to start the print operation for the next line and proceeds to S18.

Additionally, the cumulative total of the cumulative line feed amount is updated in the same manner when a page break operation is executed.

At S17, the main control part 1 rewrites the flag of the memory area of the malfunction detection request flag of the memory circuit 17 to "1" by the line feed amount cumulative calculation part 22, generates the malfunction detection request, and then proceeds to S18 in order to start the print operation for the next line. The flag indicates that the malfunction detection is necessary.

At S18, the main control part 1 supplies pulses to the space motor 6 by the carriage control part 4 and starts the print operation for the next line to print the print data that is supplied from the print control part 21 on the sheet P by the print head 5 installed on the carriage 8 while moving the carriage 8 in the first scanning direction.

With the above processes, the origin point confirmation is performed.

As mentioned above, with respect to the origin point confirmation operation of the present embodiment, since the confirmation of the origin point is performed by moving the carriage 8 to the position of the origin point detecting sensor 10 simultaneously with the line feed operation for the next line, the required time (period) for the origin point confirmation operation is shortened by the carriage moving time from the current position of the carriage 8 to the origin point, compared with a case where the origin point is confirmed after the carriage 8 is moved to the origin point sensor following the line feed. Thereby, the processing efficiency of the print operation is improved.

Moreover, when the sum of the carriage moving time B and C is shorter than the line feed time A for the next line, the origin point confirmation operation is performed simultaneously with the line feed operation for the next line. Thereby, the origin point is confirmed during the line feed operation, and the required time for the origin point confirmation operation is shortened. Therefore, the efficiency of the print processing is improved.

In the present embodiment, it is explained that the judgment line feed amount Ks is stored in advance in the memory circuit part 17. However, it is also practical to input the amount Ks through a menu screen of the operation panel 18, or to store the amount Ks as read-only data in the program.

As explained above, when the sum of the carriage moving time from the carriage position to the origin point sensor after the print operation is completed and the carriage moving time from the origin point detecting sensor to the next print starting position is shorter than the moving time of the sheet from the completion of the print operation to the next print starting position, the origin point confirmation operation of the carriage is executed by the origin point detecting sensor. Thus, the required time for the origin point confirmation operation is shortened, and the efficiency of the print operation is improved.

(Second Embodiment)

In the following description of a second embodiment, numbers are applied to the parts that are the same as those of the first embodiment. The explanations thereof are omitted.

Figure 7:
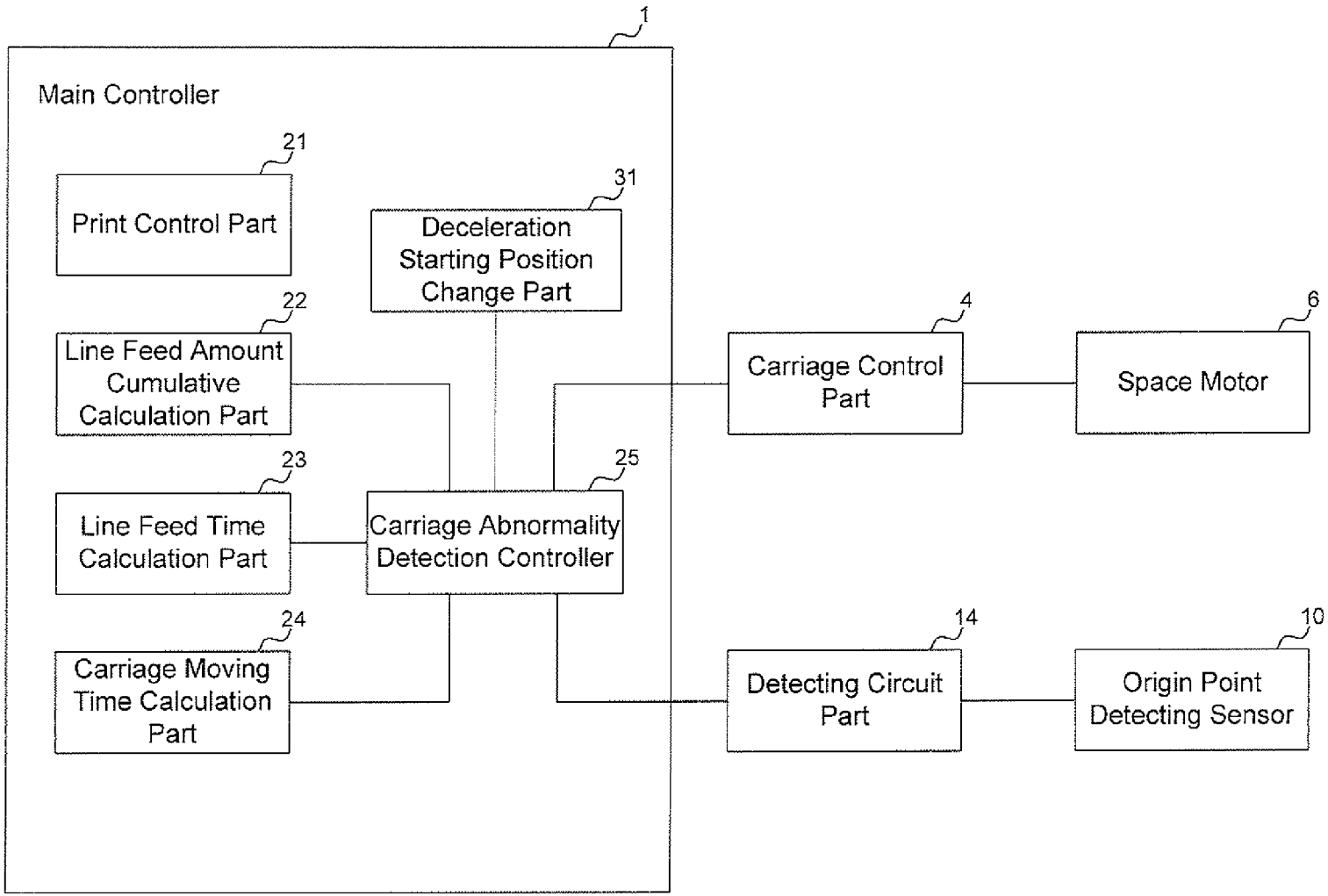
FIG. 7 is a block diagram showing a structure of a main control part of a second embodiment.

In the main control part 1 of the second embodiment, as shown in FIG. 7, a deceleration starting position change part 31 is formed that has a function to change a deceleration starting position (see FIG. 4) of the print operation.

The carriage abnormality detection control part 25, which serves as a position control part, is formed in the main control part 1 has function to execute an origin point confirmation operation. The confirmation operation includes:

to determine whether execution of the origin point confirmation operation is possible when the malfunction detection request made by the line feed amount cumulative calculation part 22 is present, when the moving direction of the carriage 8 by the space motor 6 of the carriage control part 4 is in a direction toward the origin point, at which the origin point detecting sensor 10 is provided, and when a distance from the origin point to the deceleration starting position after the completion of the print operation is equal to or less than a predetermined distance G (unit: mm), to change the deceleration starting position of the carriage 8 by the deceleration starting position change part 31 to a position in front of the origin point and to move the carriage 8 to the origin point that is logically recognized, to confirm a matching of the logical position and physical position of the carriage 8 according to whether or not the origin point detecting sensor 10 detects the carriage 8, when the positions are not matched, to edit and initialize the logical carriage position information in the memory circuit 17 by regarding the position of the carriage 8 that is detected by the origin point detecting sensor 10 as an origin point position.

Figure 8:
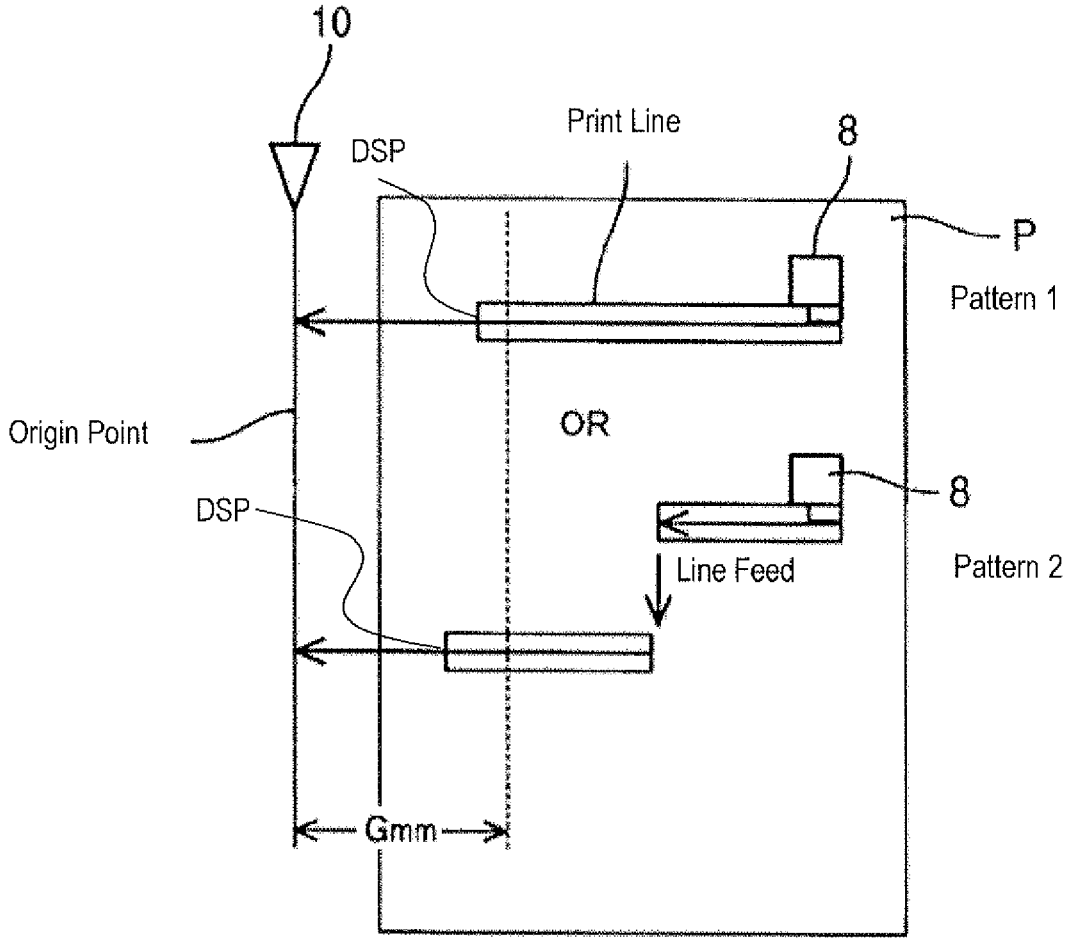
FIG. 8 is an explanatory diagram showing operation of a carriage of the second embodiment.

Moreover, the predetermined distance G, as shown in FIG. 8, is a distance that is from the origin point in order to determine whether or not the origin point confirmation operation of the present embodiment is executed. For example, the distance G is defined a distance combining two lengths: one length is from a border line on the origin point side between a margin area and a print area of the sheet P to the origin point in the first scanning direction, and the other length is approximately a quarter of the print area in the first scanning direction. The distance G is stored in the memory circuit part 17 in advance.

An origin point confirming processing of the present embodiment is configured to shorten a required time for the origin point confirmation operation by completing the moving operation of the carriage 8 to the origin point without suspending the moving operation.

That is, in the origin point confirming processing of the first embodiment, the origin point confirmation operation starts under the predetermined condition after the print operation is completed at S1. In this case, as shown in FIG. 4, the carriage 8 is accelerated at the time of starting the origin point confirmation operation is moved at a constant speed, and is then decelerated to stop at the target position (or origin point). However, in the second embodiment, the acceleration at the starting time and the deceleration at the completion time are omitted under a predetermined condition, thereby shortening the required time for the origin point confirmation operation.

Figure 9A:
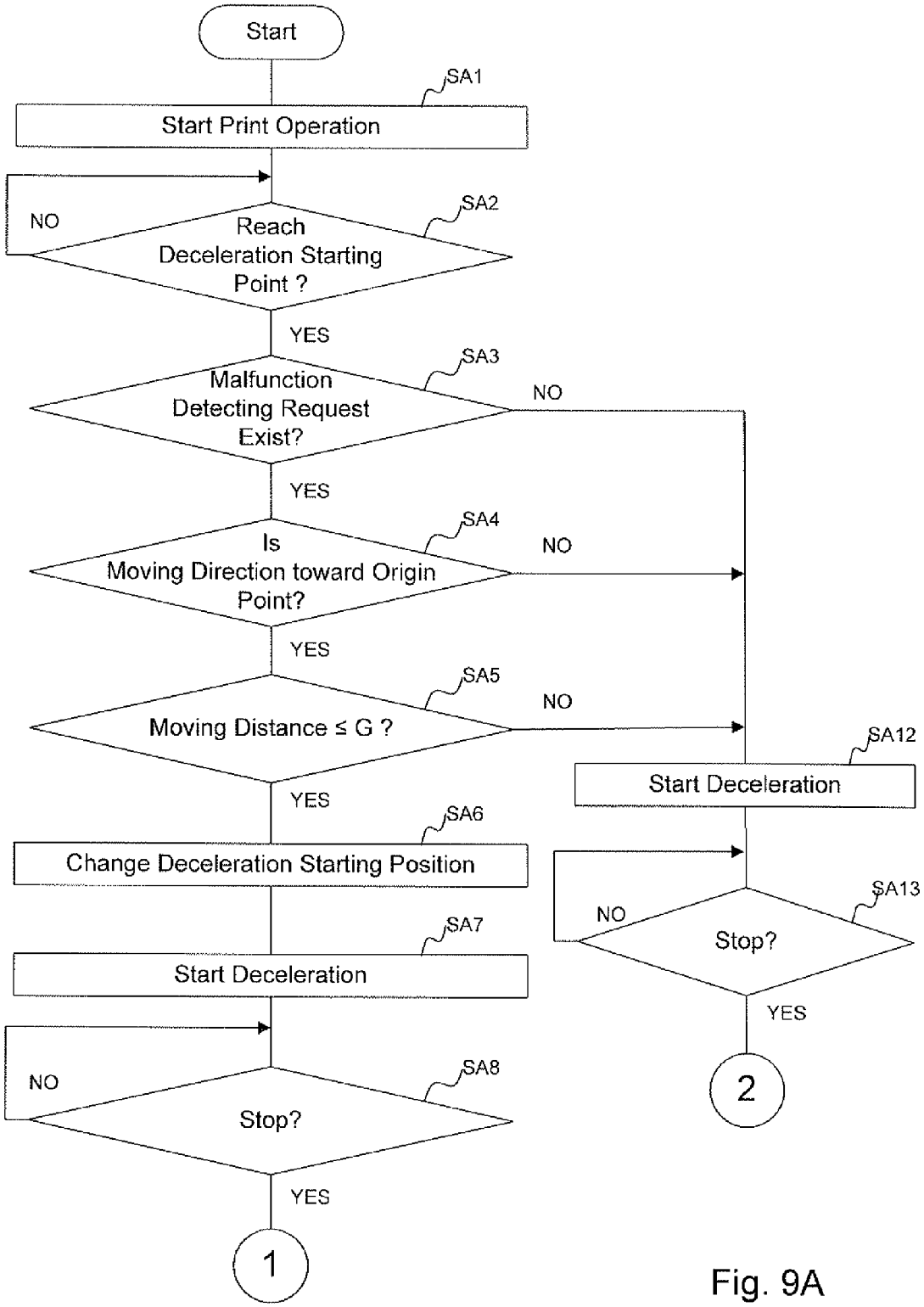
FIGS. 9A and 9B are flow diagrams showing an origin point confirmation processing of the second embodiment.
Figure 9B:
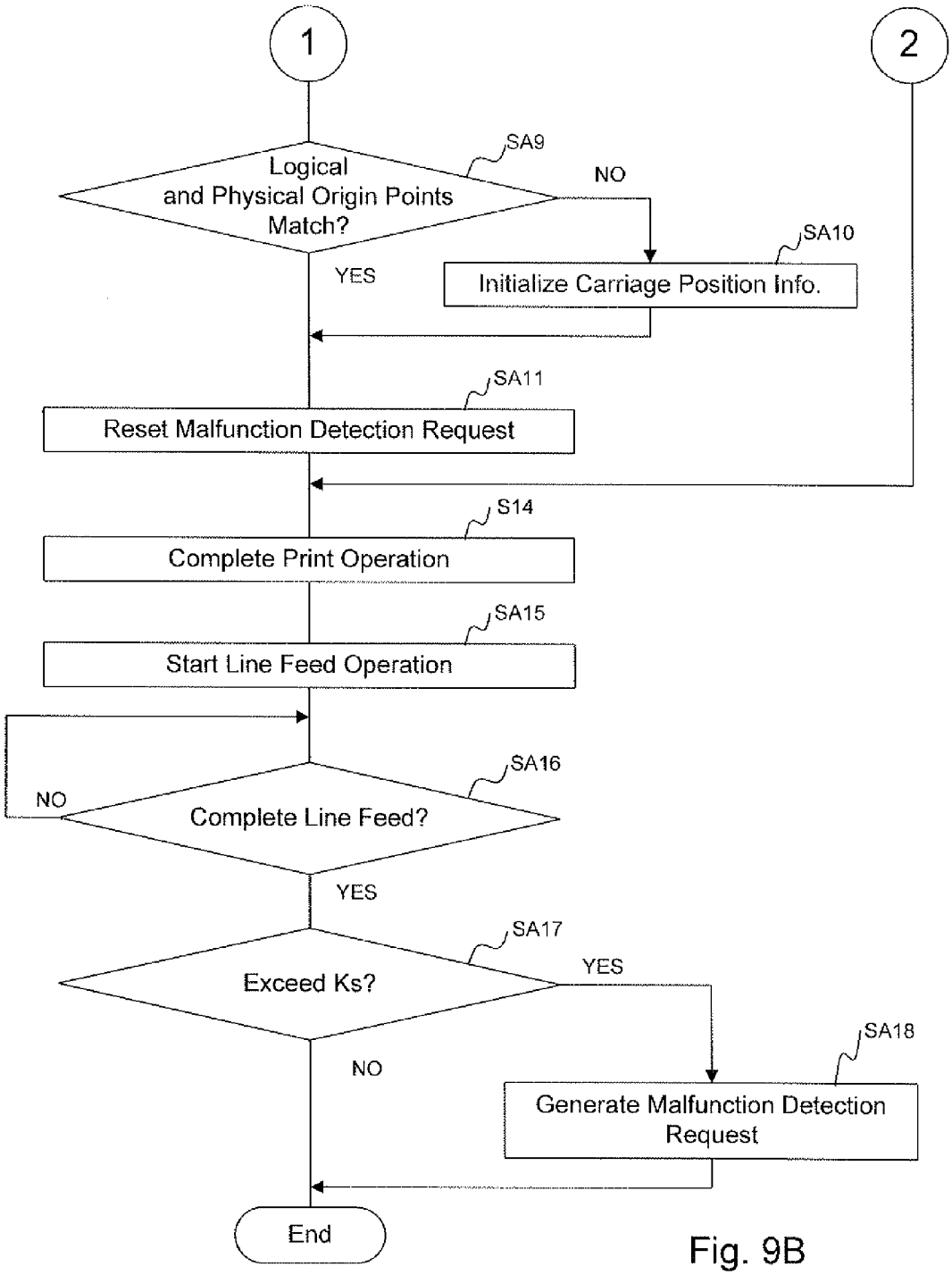

Hereafter, the origin point confirmation operation of the second embodiment is explained by the steps shown in FIG. 9 and as follows.

Like the first embodiment, when the power is turned on, the main control part 1 executes an initial operation, recognizes the origin point by the origin point detecting operation, edits and initializes the carriage position information of the memory circuit part 17, and coincides the physical position and logical position of the carriage 8. The main control part 1 starts the print operation when receiving the print order information from the host device.

At SA1, the main control part 1 sends the print data that is generated at the print control part 21 to the carriage control part 4, and starts the print operation for a single line on the sheet P while moving the carriage 8 by the carriage control part 4.

At SA2, the main control part 1 monitors by the carriage control part 4 that the carriage 8 moves to the deceleration starting position and proceeds to SA3 when the carriage 8 reaches the deceleration starting position following the completion of the line print. When the carriage 8 does not reach the deceleration starting position, the main control part 1 continues the above monitoring.

At SA3, in the same manner as S2 of the first embodiment, the main control part 1 confirms whether or not a malfunction detection request exists in the memory circuit part 17. When a malfunction detection request exists, the process moves to SA4. When no malfunction detection request is stored, the main control part 1 determines to continue the print operation of the current line and proceeds to SA12.

At SA4, the main control part 1 confirms the moving direction of the carriage 8 by the carriage abnormality detecting control part 25. When the moving direction of the carriage 8 is in a direction towards the origin point, at which the origin point detecting sensor 1 is provided, in other words, when the print operation is on a return path (approaching the origin point), the process moves to SA5. On the other hand, when the print operation is on an outgoing path (moving away from the origin point), the main control part 1 continues the print operation for the current line and then proceeds to SA12.

At SA5, the main control part 1 recognizes the current position of the carriage 8 by the carriage abnormality detection control part 25 based on carriage position information stored in the memory circuit 17. The carriage abnormality detection control part 25 calculates a difference between the current position and the origin position. Based on the difference, the carriage abnormality detection control part 25 calculates a moving distance to the origin point from the current position of the carriage 8. When the calculated moving distance is equal to or less than the predetermined distance G, which is stored in the memory circuit 17, the main control part 1 determines to execute the origin point confirmation operation and proceeds to SA6. When the calculated moving distance exceeds the predetermined distance G, the main control part 1 determines to continue the print operation for the current line and proceeds to SA12.

The carriage position information is a count value that the carriage control part 4 counts. The larger the count value is, the longer the space motor is driven. With the count value, the main control part 1 manages a driven amount of the space motor, in other words, the moving amount of the carriage 8.

As for patterns for judging the execution of the origin point confirmation operation, FIG. 8 shows two patterns as examples. Pattern 1 is where the decelerating starting position DSP of the print operation of a single line on the return path exists within the predetermined distance G from the origin point. Pattern 2 is where the line feed operation is executed after the print operation for a short line on the return path, then, the next print operation is executed for a shorter line that is shorter than a distance between the line feed point and the origin point, and the deceleration starting position DSP of the print operation exists within the predetermined distance G from the origin point.

At SA6, the main control part 1 changes the deceleration starting position by the deceleration starting position change part 31, so that the logical origin point becomes the deceleration completing position, sends the result to the carriage abnormality detection control part 25, and continues the moving operation of the carriage 8 with the constant speed.

At SA7, the main control part 1, which continues the constant speed operation of the carriage 8, monitors the carriage 8 to move up to the changed deceleration starting position. When the carriage 8 reaches the changed deceleration starting position, the main control part 1 starts the deceleration of the carriage 8 and proceeds to SA8. When the carriage 8 does not reach the deceleration starting position, the above monitoring operation continues.

At SA8, the main control part 1 monitors the stopping of the carriage 8 by the carriage abnormality detecting control part 25, and the process moves to SA9 when the carriage 8 stoppage by the deceleration is completed. When the carriage 8 is in a decelerating process, the monitoring operation continues.

Like S11 of the first embodiment, at SA9, the main control part 1, which stopped the carriage 8 at the logical origin point, confirms whether or not the logical origin point and the physical origin point match. When these points match, the main control part 1 determines that the status is normal and proceeds to SA11. When these points do not match, the main control part 1 determines that the status is abnormal and proceeds to SA 10.

The operations of SA10 and SA11 are the same as S12 and S13 of the first embodiment, and an explanation thereof is omitted.

On the other hand, at SA12, the main control part 1, which determined to continue the print operation of the current line, starts the deceleration of the print operation for the line by the carriage control part 4.

At SA13, the main control part 1 monitors a stoppage of the carriage 8 by the carriage control part 4 and proceeds to SA14 when the carriage 8 stops at the print completing position for the current line following the completion of the deceleration of the carriage 8. When the carriage 8 is in the deceleration process, the monitoring continues.

At SA14, the main control part 1, which finished the execution of the origin point confirmation operation or the print operation for the current line, determines the completion of the print operation for the single line and proceeds to SA15.

At SA15, the main control part 1 rotates the line feed motor 13 in the carrying direction of the sheet P by the carrying part 12 and starts the line feed operation for the next line.

At SA16, when the main control part 1 confirms that the line feed operation is completed, the process moves to SA17. When the line feed operation is in the middle of the process, the main control part 1 continues the monitoring.

Like S16 of the above first embodiment, at SA17, the main control part 1 updates the cumulative line feed amount. When the updated cumulative line feed amount exceeds the judgment line feed amount Ks, the process moves to SA18. When the updated cumulative line feed amount is equal to or less than the judgment line feed amount Ks, the main control part 1 determines to start the print operation for the next line, returns to SA1, and starts the print operation of the next line.

At SA18, the main control part 1 rewrites the flag of the memory area of the malfunction detection request flag of the memory circuit part 17 to "1," generates the malfunction detection request, returns to SA1, and starts the print operation of the next line.

With the above processes, the origin point confirming processing of the present embodiment is executed.

As described above, in the origin point confirmation operation of the present embodiment, where the moving direction of the carriage 8 is in the direction towards the origin point, at which the origin point detecting sensor 10 is provided, and where the distance from the position of the carriage 8 that is at the deceleration starting position to the origin point detecting sensor 10 is equal to or less than the predetermined distance G, the deceleration of the carriage 8 during the print operation is omitted, and the carriage 8 is moved to the position of the origin point detecting sensor 10 with a constant moving speed so that the origin point is confirmed. Accordingly, the deceleration and acceleration of the carriage during the print operation is omitted, thus the efficiency for the print processing is improved by shortening the required time for the origin point confirmation operation.

Additionally, in the present embodiment, it is explained that the change of the deceleration starting position of the origin point confirmation operation is performed when the carriage 8 reaches the deceleration starting position. However, the deceleration starting position can be changed in advance when the deceleration starting position is known before the print operation starts.

As explained above, in the present embodiment, where the moving direction of the carriage is in the direction toward the origin point detecting sensor, and where the distance from the carriage position after the print is completed to the origin point detecting sensor is equal to less than the predetermined distance G, the carriage is moved to the origin point as it is, then, the origin point confirmation operation by the origin point detecting sensor is executed. Thereby, the required time for the origin point confirmation operation is shortened, and the processing efficiency of the print processing is improved.

What is claimed is:

1. A printing device, comprising:

a carriage control part that reciprocates a carriage, in which a print head is installed, in a first scanning direction;

a print control part that provides print data to the print head;

a carrying part that carries a recording medium that is printed by the print head;

a position detecting part that is provided on an origin point that is set on a path of the carriage; and a position control part that confirms the origin point of the carriage by the position detecting part;

a carriage moving time calculation part that calculates a first moving time (B) and a second moving time (C), wherein the first moving time is defined as a period during which the carriage moves from the carriage position to the position detection part after a print completion, and the second moving time is defined as a period during which the carriage moves from the position detection part to a next print starting position; and a line feed time calculation part that calculates a third time (A) defined as a period during which the recording medium is carried from the print completion to the next print position, wherein the position control part executes an origin point confirmation operation of the carriage by the position detection part when a sum of the first and second times is less than the third time (B+C<A).

2. The printing device of claim 1, further comprising a line feed cumulative calculation part that calculates a cumulative line feed amount, wherein the cumulative line feed amount is an amount of line feeds that are cumulatively counted from a previous origin point confirmation operation to the present.

3. The printing device of claim 2, further comprising a memory part that stores an upper limit line feed amount (Kj), which is a line feed amount predetermined to cause performance of the origin point confirmation operation.

4. The printing device of claim 3, further comprising a control part that determines whether or not the cumulative line feed amount is larger than the upper limit line feed amount, wherein when the cumulative line feed amount is larger than the upper limit line feed amount, the position control part executes the origin point confirmation operation of the carriage by the position detection part.

5. The printing device of claim 2, further comprising a memory part that stores a predetermined line feed amount (Ks).

6. The printing device of claim 5, wherein the line feed cumulative calculation part determines whether or not the calculated cumulative line feed amount is larger than a predetermined line feed amount, and generates a request of an origin point confirmation operation when the cumulative line feed amount is larger than the predetermined line feed amount, and the control part determines whether or not the sum of the first time and the second time is shorter than the third time when the origin point confirmation operation request exists.

7. The printing device of claim 1, further comprising a first motor that drives the carriage.

8. The printing device of claim 1, wherein the carrying part provides a second motor that drives the recording medium.

9. A method of printing comprising:

providing print data to a print head, which is located on a reciprocating carriage that travels in a first direction and along a carriage path;

carrying a recording medium in a second direction, wherein the second direction is transverse to the first direction, and wherein the print head prints on the recording medium according to the print data;

determining when the carriage is located at an origin point, which is located on the carriage path;

calculating a first moving time (B), a second moving time (C), and a third time (A), wherein the first moving time is defined as a period during which the carriage moves from a carriage position to the origin point after completion of a first print operation, the second moving time is defined as a period during which the carriage moves from the origin to a second print operation starting position; and the third moving time is defined as a period during which the recording medium is carried from a position at which the recording medium is located when the first print operation is completed to a position of the recording medium at which the second print operation is started, and performing an origin point confirmation operation of the carriage when a sum of the first and second times is less than the third time (B+C<A).

10. The method according to claim 9, wherein the method includes calculating a cumulative line feed amount, wherein the cumulative line feed amount is an amount of line feeds that are cumulatively counted from a previous origin point confirmation operation.

11. The method according to claim 9, wherein the method includes storing an upper limit line feed amount (Kj), which is a line feed amount predetermined to cause performance of the origin point confirmation operation.

12. The method according to claim 11, wherein the method includes determining whether or not the cumulative line feed amount is larger than the upper limit line feed amount, wherein when the cumulative line feed amount is larger than the upper limit line feed amount, the origin point confirmation operation of the carriage is performed.

* * * * *